US007070385B2

(12) United States Patent
Milana

(10) Patent No.: US 7,070,385 B2
(45) Date of Patent: Jul. 4, 2006

(54) VERSATILE AXIAL FAN AND CENTRIFUGAL SHUTTER MECHANISM

(75) Inventor: Angelo Milana, Laval (CA)

(73) Assignees: Marisa Milana, Laval (CA); David Milana, Laval (CA)

( * ) Notice: Subject to any disclaimer, the term of this patent is extended or adjusted under 35 U.S.C. 154(b) by 160 days.

(21) Appl. No.: 10/679,475

(22) Filed: Oct. 7, 2003

(65) Prior Publication Data

US 2004/0081553 A1 Apr. 29, 2004

(30) Foreign Application Priority Data

Oct. 29, 2002 (CA) ..... 2405088

(51) Int. Cl.
*F04D 25/14* (2006.01)
*F04D 25/08* (2006.01)

(52) U.S. Cl. ..... 415/25; 415/125; 415/220; 415/223; 416/247 R; 417/362; 417/423.15; 454/259; 454/351; 454/353

(58) Field of Classification Search ..... 415/25, 415/125, 208.1, 211.2, 220, 223; 416/247 R; 454/259, 208, 351, 353; 417/362, 423.15
See application file for complete search history.

(56) References Cited

U.S. PATENT DOCUMENTS 1,648,796 A * 11/1927 Albrecht ..... 454/259
2,397,171 A * 3/1946 Troller et al. ..... 417/368
2,468,366 A * 4/1949 Habinski ..... 454/352
2,612,831 A * 10/1952 Lohman, Jr. ..... 454/343
2,775,928 A * 1/1957 Morrison ..... 454/353
2,875,626 A * 3/1959 Niederer et al. ..... 417/362
3,265,372 A * 8/1966 Bradley ..... 417/362
3,917,433 A * 11/1975 Tomitaka ..... 454/353
4,217,816 A * 8/1980 Mancinelli ..... 415/125
4,445,426 A * 5/1984 Bohanon, Sr. ..... 454/351
4,502,846 A * 3/1985 Cavanna ..... 417/362
5,195,928 A * 3/1993 Gigola ..... 454/352
5,288,202 A * 2/1994 Mancinelli ..... 415/25
6,276,895 B1 * 8/2001 Milana ..... 415/25
6,386,828 B1 * 5/2002 Davis et al. ..... 454/353

* cited by examiner

*Primary Examiner*—Christopher Verdier

(57) ABSTRACT

An efficient axial fan has a housing enclosure with a square inlet opening and a round outlet opening, a fan assembly with a drive motor and a propeller secured to a shaft and coupled thereto. The entrance of the fan housing is provided with a shutter assembly which is disposed horizontally or vertically across the square inlet opening and comprises a plurality of vanes including a central vane operated by a centrifugal shutter mechanism secured to one end of the propeller shaft, opposite to the propeller and adjacent to the central vane of the shutter assembly. The centrifugal shutter mechanism is normally provided with a hermetic housing comprising a pair of radial masses operatively connected via a pair of pivoting arms to an axial sliding reciprocating actuator which is disposed adjacent to the shutter central vane.

5 Claims, 9 Drawing Sheets

VERSATILE AXIAL FAN AND CENTRIFUGAL SHUTTER MECHANISM

BACKGROUND OF THE INVENTION

1. Field of the Invention

This invention pertains generally to an energy efficient axial fan for exhausting humid, corrosive and dusty air from a variety of buildings, including, by way of example: foundries, manufacturing facilities, poultry operations, green houses, etc. . . .

More particularly, the present invention relates generally to new and useful improvements of axial fans comprising a shutter operated by a centrifugal mechanism.

2. Description of the Prior Art

Most axial fans are provided with gravity shutters. They are closed by gravity and opened by the airflow exiting the fan. When said fans operate in dusty atmospheres, if air velocity across the shutters is lower than the minimum velocity to prevent dust settling, said dust quickly accumulates on the shutters increasing the overall weight of the shutters. The heavier the shutters are, the harder it is for the fan to blow air through them. As a result, the fan moves less air and efficiency is reduced. Therefore, gravity shutters need routine cleaning but, after cleaning them, just after a few days of operation, they are once again covered with dust and one can clearly see them hanging at an angle, partially closed again. During the cleaning operation, it is possible to damage them resulting in shutters not closing or opening completely.

Cleaning the shutters is a difficult task and therefore, they are not cleaned as often as they should. Dust build up creates undesirable flow restrictions, which reduces the airflow capacity of the fan and affects the opening and closing of the shutters. As a result, it causes undesirable air infiltrations and building heat losses.

The air moving capacity of a fan with gravity shutters is also negatively affected by stormy weather. If a strong wind hits the operating fan, the shutters close partially. The wind lets up and the shutters open again. When the fan is off, high winds can open said shutters admitting unexpected cold or warm air into the building or allowing the inside air to escape therefrom.

When the fan with gravity shutters is operating, there is always a "constant battle" between the airflow blowing the shutters open and the gravity forces trying to close them. This results in a continuous oscillation of the shutters, pressure losses, waste of energy, vibrations, wear and reduction of airflow.

An axial fan is provided with a housing enclosing a fan comprising a motor and a propeller coupled thereto. Said propeller comprises a plurality of radial blades having tips running at close distance with a Venturi or orifice.

Enhancing the state-of-the-art in air moving axial fans mainly focuses on three directions: First, the ability to smoothly transmit the air from the intake opening of the fan housing into the inlet side of the Venturi and the propeller. Second, the ability to decrease the gap between the said Venturi and the said propeller blades tips. Third, the ability to provide the propeller and other elements exposed to airflow with airfoil shaped surfaces. Airfoil shaped blades assure the quietest and most efficient operation of the fan.

In conventional axial fans, due to the limited capabilities of the prior techniques in manufacturing and producing with precision fan housings and Venturi, the performance of the fans has been limited. Designers were obliged to leave a relatively large tip blade clearance to accommodate imperfection of manufacturing and thermal variations and expansions of the propeller blades and or the Venturi for preventing, in same situations, the fan blades to come into contact with said Venturi. Many studies show that the larger this space is, the lower the fan efficiency.

Motorized shutters or centrifugal shutter systems have been successfully utilized to solve the problems of said gravity shutters. The motorized shutters are relatively expensive; therefore the art has developed various centrifugal systems to operate said shutters, to fully open and keep them positively open in spite of the inevitable dust accumulation thereon and stormy weather.

The use of said centrifugal systems enhance the fan performance because said devices open the shutters wider and because the air pressure losses of said conventional gravity shutters, caused by the out-flowing air required to keep said shutters opened, are eliminated. Air is allowed to flow unobstructed through the positively wide-pen shutters.

Using a centrifugal device translates to significantly reduce the workload of the drive motor. This allows a reduction of energy or reallocation of this power surplus.

A thorough description of the prior art known to the Applicant which is pertinent to the present application is described in the following patents:

| INVENTOR | U.S. Pat. No. | DATA GRANTED |
|---|---|---|
| Mancinelli | 4,217,816 | August 1980 |
| Gigola | 5,195,928 | March 1993 |
| Mancinelli | 5,288,202 | February 1994 |
| Milana | 6,276,895 | August 2001 |

In the known art, better described in U.S. Pat. No. 6,276,895 by this Applicant, the problems of vibrations and rattling were solved, but dust accumulation and air leakage from the shutters were not.

The fans with centrifugal devices of the prior art include an electric motor, a propeller and a shutter assembly comprising of a plurality of horizontal extending shutters or vanes including a central operative vane located in proximity to the propeller. The centrifugal devices of Mancinelli comprise of two centrifugal masses whereas the one of Gigola comprises three masses rotating with the propeller. As soon as the drive motor of said fans starts, the propeller speeds up, therefore the rotating masses move outwardly radially away from the fan axis of rotation due to centrifugal action. Through a series of complex linkages, the movement of the masses forces the shutter wide open even in stormy weather. As the fan shuts off, the centrifugal masses move back toward the propeller rotational axis. As a result, the vanes of Mancinelli, assisted by springs, firmly close, while the vanes of Gigola close by gravity.

While having these and other advantages, the fans of Mancinelli and Gigola have some disadvantages. For example, the centrifugal mechanism needs routine maintenance and their horizontal disposed vanes must be cleaned regularly. Said vanes are disposed at the fan exhaust where air velocity is relatively higher than at the intake; so the pressure losses are greater and efficiency is reduced.

In addition, the above centrifugal devices comprise an axially sliding actuator rotatably connected with the shutter central operative vane for transmitting, through complex linkages, the centrifugal forces of said masses. Therefore, the actuators transmit to said shutter the vibrations of the propeller as well as the vibrations of the centrifugal mechanisms. Moreover, when said fans are in operation, said mechanisms push continuously the shutter via a thrust bearing. For that reason, said vanes are subject to continuous friction, oscillations and wear.

None of the known fans of the prior art solves the problems of dust settling on their horizontally disposed shutters or vanes. In addition, none of said fans have the unique feature of the fan of the present invention.

There remains the need for a fan with a self-cleaning shutter suitable to prevent the usual dust accumulation on the shutters of the prior art fans. The Applicant in effect finds that designing the shutter with vertically extending vanes serves to overcome the problem of dust settling on the shutters so to achieve a self-cleaning effect. However, a shutter with vertical pivoting vanes must be operated by a device, for example a centrifugal mechanism.

Various studies from many Universities for poultry house buildings show that dust accumulation on conventional shutters of prior art fans can cause a reduction of the airflow by 30%. If said fans move 30% less air than they should, more fans are required to do the work resulting in higher electricity bills and increased wear on said fans.

The farm buildings usually require a large number of fans which, during hot weather, operate 24 hours a day and therefore require a significant energy use. Thus, it is important to solve the dust problem on shutters to ensure high operating efficiency and a maintenance free fan with improved self-cleaning shutters or vanes to conserve electrical energy over the long period that the fan is operated.

There is a need and a demand for a high energy efficient practically maintenance free fan with the unique features described hereinafter.

SUMMARY OF THE INVENTION

The longstanding but heretofore unfulfilled need for a high efficiency fan to move efficiently large volume of humid, corrosive and dusty air with a minimum of maintenance is now fulfilled by the invention disclosed hereinafter and summarized as follows.

The present invention provides an energy efficient axial fan comprising a housing mounted externally through a building wall at a downwardly slanted angle thereto.

For example, Applicant shows an axial fan comprising a propeller mounted within a housing enclosure comprising a square intake opening with a self-opening shutter assembly comprising a plurality of vanes including a central operative vane interconnected with crank rods and at least a tie rod, said central operative vane extending horizontally or vertically across the intake opening. Said vanes move in unison, smoothly and noiselessly from a first closed position to a second open position to close or open said square intake opening. The shutter assembly further comprises a square frame on which are mounted said vanes and further comprises an inlet bell-mouth and an extension operative spring located between said frame and said tie rod for causing the fully opening of said shutter vanes upon fan rotation.

The fan housing enclosure further comprises an axially spaced second opening of round cross section, a streamlined central structural member, axially spaced between said openings and connecting two opposite sides of the fan housing enclosure and comprising a pair of airfoil wings, a drive motor comprising a drive pulley transmitting power via a belt to a propeller and a Venturi or orifice for guiding the airflow.

The propeller comprises a hub with a pulley axially adjacent said hub secured to one end of a rotating shaft journaled on a pair of rigid pillow block bearings secured to said central structural member for rotatably supporting said rotating shaft. The propeller comprises a plurality of airfoil shaped blades pivotally mounted on said hub extending radially outwardly therefrom said hub toward a tip region. Said propeller blades further comprise means for minimizing the tip blade clearance with said Venturi.

An important feature of the present invention is the introduction of a centrifugal shutter mechanism mounted upon the propeller-rotating shaft. It includes means for locking said shutter in its closed position when the fan is not in operation and comprises means for allowing the shutter vanes to open as soon as the fan starts to run. It is simple in design, compact, and it has a minimum number of parts and joints for preventing excessive looseness of the mechanism even after long-term use. It is suitable for pulling or pushing an element to be actuated, therefore, is suitable for many other applications.

In dusty environments, the dust or other foreign matter are able to collect on the fan shutters or vanes causing the aforementioned problems and eventually causing the jamming of the centrifugal shutter mechanism.

The problems of dust build up associated with conventional typical horizontally extending shutters of prior art fans may be substantially overcome by providing a fan with a slanted housing having a shutter assembly comprising vertical pivoted vanes operated by a centrifugal shutter mechanism. It is evident that dust present in the air passing through said vertically mounted vanes will tend by gravity to settle mainly on the bottom of the fan housing. Thus, it will not settle on the vertical surfaces of the vertical pivoted vanes, thereby a fan formed in accordance with the present invention has the noticeable advantage of having self-cleaning shutters or vanes which, contrary to the prior art shutters, will not need frequent maintenance.

In addition, for preventing dust accumulation on the centrifugal shutter mechanism, the Applicant provides a hermetic housing for enclosing the components of the centrifugal mechanism.

However, vertically mounted vanes opened by air and or by a spring or by a centrifugal device or by other means, need a device for closing them. For example, the Applicant provides a centrifugal shutter mechanism which comprises a pair of radial masses equally spaced apart in respect to the fan axis of rotation, located inside said hermetic housing, operatively connected via a pair of pivotal arms to an axial sliding reciprocating actuator comprising an internal compression spring, located coaxial to the fan axis of rotation adjacent to the shutter central operative vane.

Said axial actuator has, more specifically, one operational end including means adapted for frictionally engaging and rotating said central operative vane from one first opened position to a second closed position and vice versa to open or to close said intake opening of said fan.

When the fan is rotated, for example by an electric or hydraulic motor, said pair of masses move radially by centrifugal force and pushes, via the pair of pivotal rotating arms, the axial sliding reciprocating actuator inward the hermetic housing, against the urge of the internal compression spring, whereby said axial sliding reciprocating actuator gradually frees said central operative vane of said shutter allowing the aforesaid extension spring of said shutter frame, as the propeller reaches the minimum designed operating speed, to rotate, quietly, quickly and smoothly all vanes in their open position.

This fan is particularly suitable to operate efficiently at variable speed and in very dusty atmospheres. Its shutter vanes are designed to be wide open when the propeller reaches the speed of about 250 RPM. At this low speed the power requirements are relatively low and the cost to operate the fan is significantly reduced. In hot weather the fan in a farm building usually runs 24 hours a day, seven days a week, the saving of electricity adds up and the energy saving becomes noticeable.

When the fan is stopped, the centrifugal forces of said pair of masses progressively decrease, whereby said compression spring progressively expands pushing out the axial sliding reciprocating actuator towards said central operative vane, which is compelled to rotate gradually around its longitudinal axis for assuming a closed position. At the same time, said tie rod will rotate all the other vanes in their closed position.

The centrifugal shutter mechanism can operate for either direction of rotation and therefore the fan can be used in applications for moving air in exhaust or intake mode.

The operating characteristic and the simplicity of design of the centrifugal mechanism of this invention gives many advantages over existing centrifugal devices thus making it applicable to many different uses such as closing electric components, switches, valves and the likes.

On the other hand, it will be recognized by those skilled in the art that for some of said applications, it may be desirable to have the centrifugal shutter mechanism adapted to pull or push the element to be operated. In this case the centrifugal mechanism of the present invention is rotatably coupled with a thrust bearing to the element to be actuated in order to apply a pulling or pushing force to it. This reverse action is to be considered part of the present invention.

OBJECT OF THE INVENTION

It is a primary object of the present invention generally to teach certain additional useful improvements upon the "Fan with centrifugal shutter mechanism" taught in my U.S. Pat. No. 6,276,895 granted August 2001.

A very important object of the present invention is to solve the problems concerning dust settling on prior art shutter vanes and leakage of air therefrom.

Another very important object of the present invention is to provide means for adjusting the propeller blade tips clearance with the Venturi.

Another important object of the present invention is to reduce the cost of the axial fan. This objective is possible with a simplification, reduction of the number of parts and joints and increase fan performance.

Another object of the present invention is to provide a shutter assembly with shutters or vanes mounted either horizontally like the ones of prior art fans or preferably vertically when the fans have to handle very dusty air, thus preventing dust build up on the vertical surfaces of said vanes.

A further object of the invention is to provide a safe centrifugal mechanism, simple in construction, positive in operation, designed to function for long periods of time and in a very large range of speeds without frequent servicing and repairs and adapted to work for pushing or pulling an element to be actuated.

Another object of the present invention is to provide an affordable, highly efficient fan which will require minimal installation space, shipping volume and maintenance.

BRIEF DESCRIPTION OF THE DRAWINGS

For a better understanding of the innovatory principles, objects, features, aspects, and advantages of the present invention with respect to the prior art, reference should be made to the following detailed description of the preferred embodiments thereof which, are to be taken in connection with the accompanying drawings given by a way of example and thus are not limitative of the present invention and wherein:

FIG. 3 B is a plan view partially in section of the fan along the line 3—3 of FIG. 1B showing a self-opening shutter assembly with their vertical pivoted vanes mounted across the fan intake and in their open position. The motor has been removed and the fan housing not slanted for clarity.

DETAILED DESCRIPTION OF THE PREFERRED EMBODIMENTS

Figure 1A:
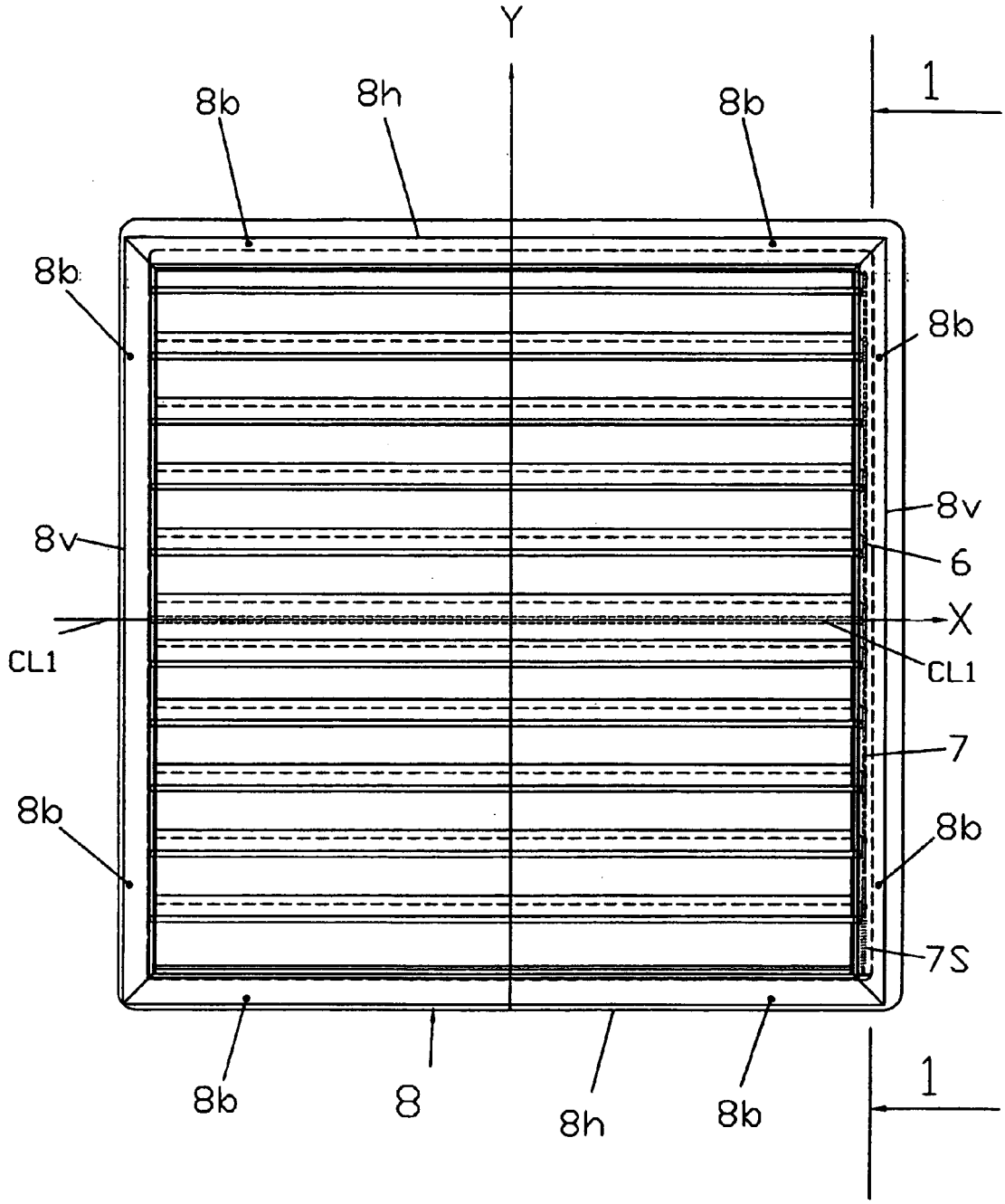
FIG. 1A is a rear view of the fan looking toward the intake side of the fan showing a self opening shutter assembly with shutters or vanes mounted horizontally across the fan intake and with the vanes in their closed position.

FIGS. 1A, B, 2H, 3A and 3B show the components of an axial belt driven fan generally indicated 1 as a whole. These components include an improved compact housing enclosure 2 having an inner cavity defining an air flow passageway with large radii corners adapted to be installed into a square wall opening of a building at a downwardly slanted angle thereto away from the building wall so that air flow, drainage and laden dusty air can easily pass therethrough.

Said compact slanted housing enclosure 2 is shaped such as to provide for high airflow, low noise and is preferably molded in one piece of plastic formed with the method of rotational molding or is made of fiberglass with the method of resin transfer molding process technology or by sheet metal.

The rotational-mold housings has the advantage of being cost effective, however, it has the disadvantage of having an undesirable large degree of movements in the plastic due to temperature variations. Therefore, this method cannot be used for large size fans unless a precise roll-formed rigid ring is fitted in the inner part of the fan housing adjacent to the propeller blades tips.

The fan housing enclosure 2 comprises a square intake opening 3 comprising a mounting flange 2*f* adapted for securing it to the square wall opening of said building and for securing a self-opening shutter assembly 4 comprising a square frame assembly 8 comprising a pair of vertical positioned lateral jambs 8*v* and a pair of top and bottom rails 8*h* extending across the width of said square wall opening of said building wall, an inlet bell mouth 8*i*, a plurality of individual shutter vanes 5 comprising a central operative vane 5*c*, comprising a convex shaped cam 5*c*" mounted in the middle thereof. Each of said vanes is pivotally received into plastic bearings rod 8*p* mounted into longitudinal extending cavity 8*c* of said extruded frame assembly 8.

Figure 1B:
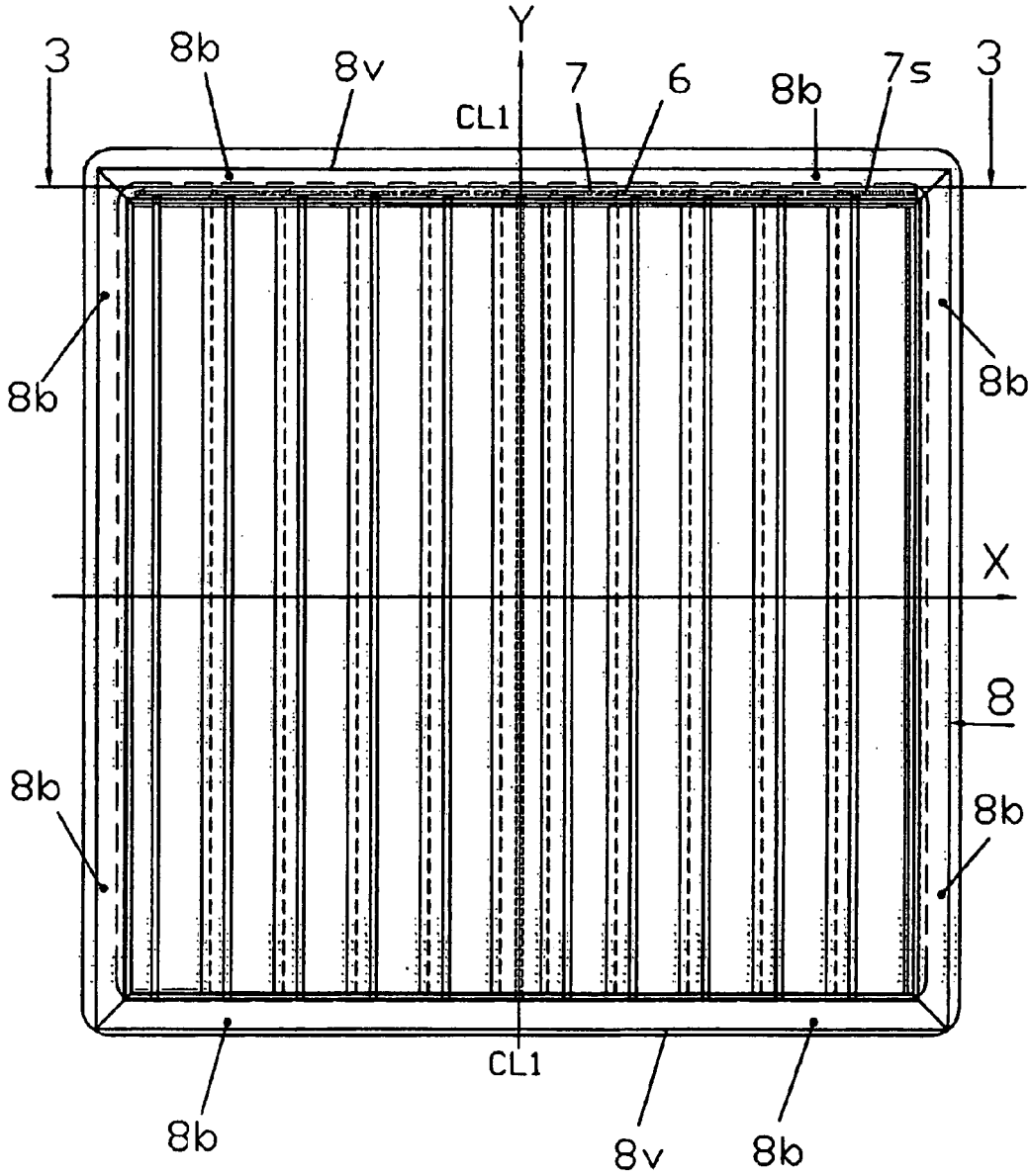
FIG. 1B is a rear view of the fan looking toward the intake side of an axial fan showing a self-opening shutter assembly with vertical pivoted shutters or vanes mounted vertically across the fan intake with the vanes in their closed position
Figure 2:
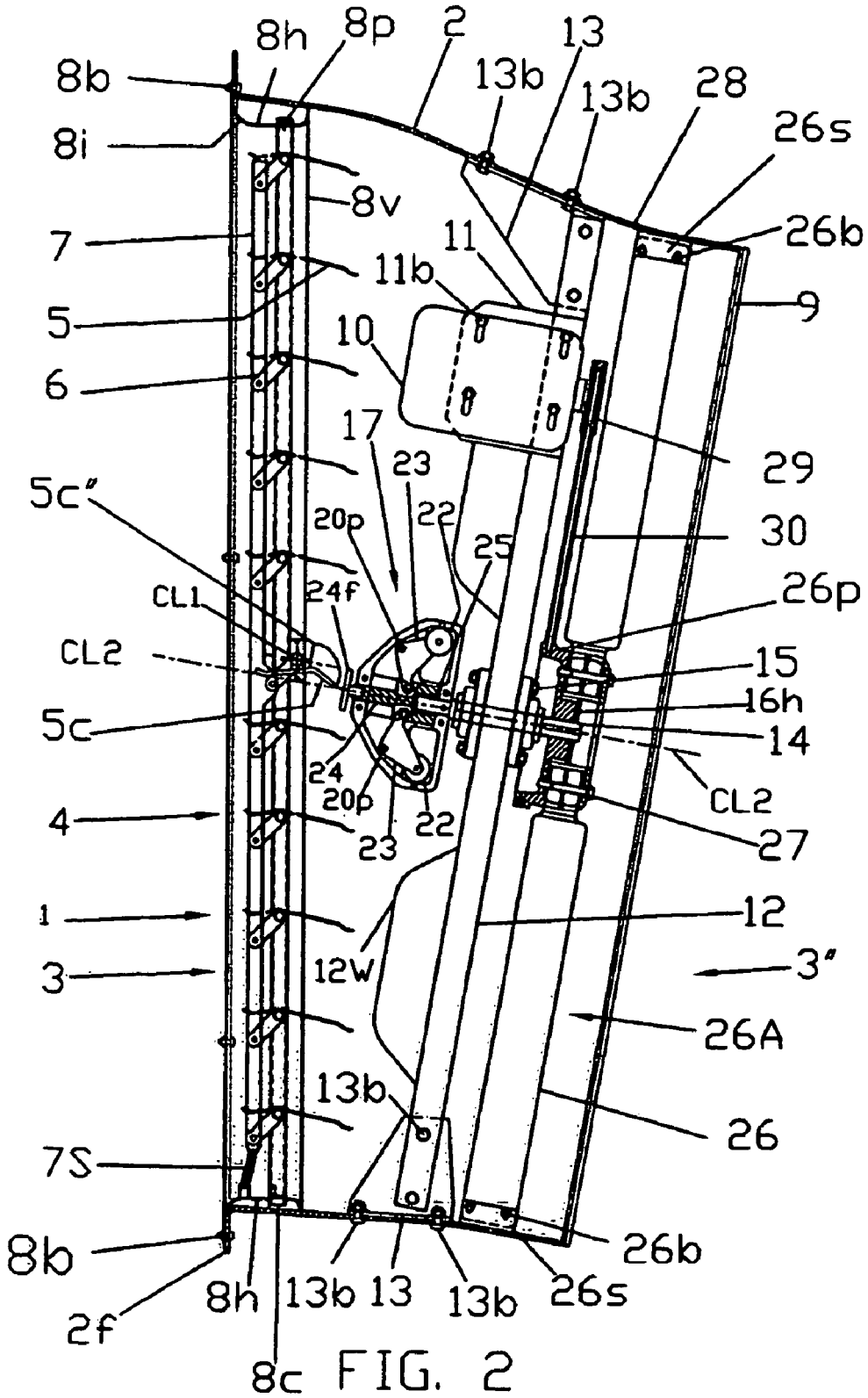
FIG. 2 is a side elevation view, partially in section, of the fan along line 1—1 of FIG. 1A showing the fan with a slanted housing and a self-opening shutter with vanes extending horizontally across the fan-intake in their open position-aligned with the airflow.
Figure 3A:
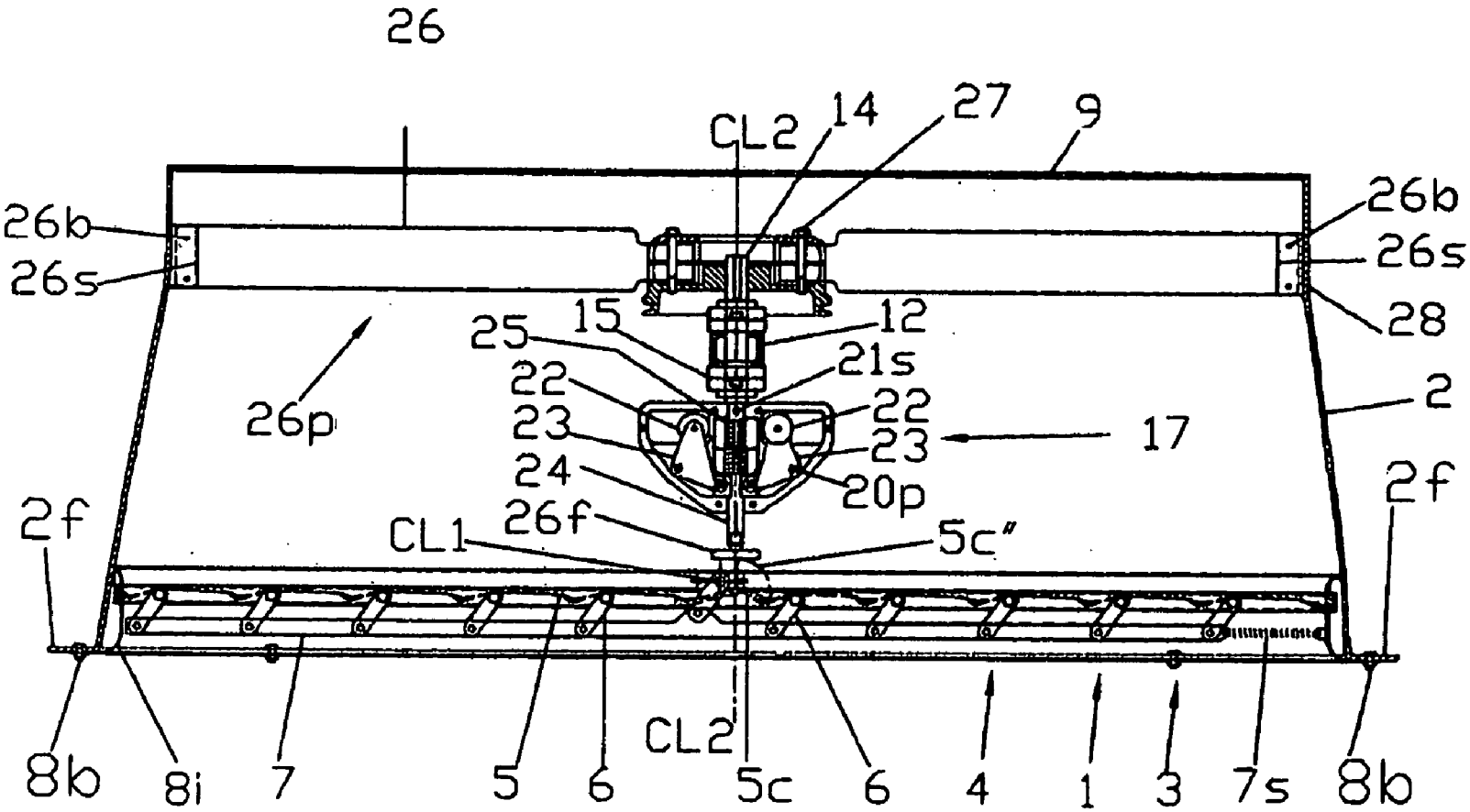
FIG. 3 A is a plan view partially in section of the fan along the line 3—3 of FIG. 1B showing a self-opening shutter assembly with their vertical pivoted vanes mounted across the fan intake and in their closed position. The motor has been removed and the fan housing not slanted: for clarity.
Figure 3B:
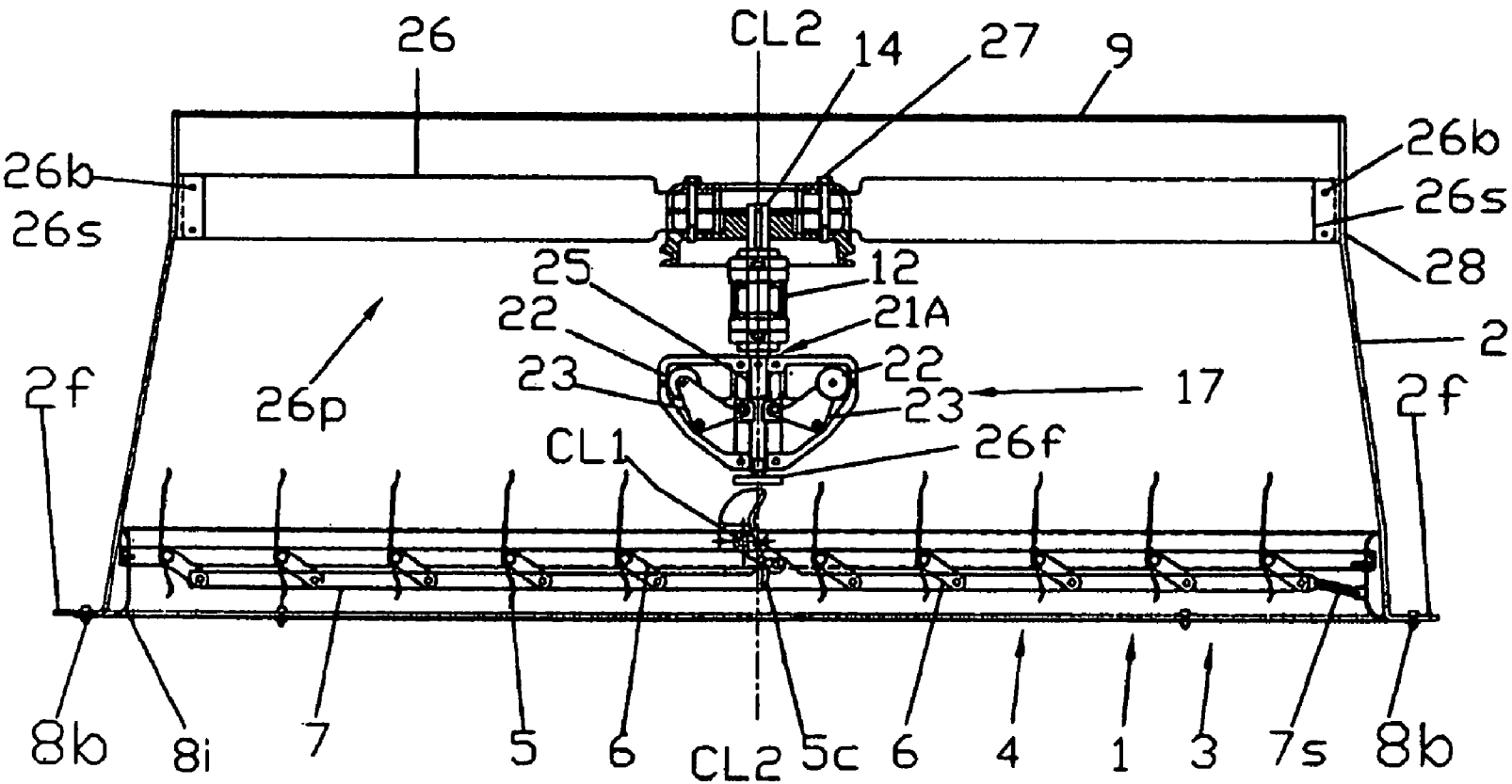

Said shutter vanes 5 and 5*c* can be selectively mounted across said square intake opening of said fan housing, either horizontally, as shown on FIG. 1A and FIG. 2 with its longitudinal axis parallel to the top and bottom sides of the square inlet opening 3 or vertically, as shown in FIGS. 1B, 3A and 3B with its longitudinal axis parallel to the vertical sides of said square opening of the building wall.

As best seen in FIG. 1A and FIG. 2H, the Applicant shows as example a self-opening shutter assembly 4 comprising said plurality of vanes 5 and the central operative vane 5*c* extending horizontally across the square inlet opening 3 of said fan housing enclosure 2, each of said vanes are pivotally mounted to said jambs 8*v* of said shutter frame assembly 8. Said vanes 5 and 5*c* are pivotally connected to each other with cranks 6 and at least one be rod 7 which extends along at least one side of said vanes 5 and 5*c* and interconnects adjacent vanes to each other for unison closing or opening. Through this arrangement, movements of the tie rod 7 in the direction of its length will cause each of said vanes 5 and 5*c* to pivot in unison to close or to open said shutter assembly 4.

The frame assembly 8 is bolted with bolts 8*b* to the fan square intake opening 3 of said fan housing enclosure 2 and forms, when properly mounted in place, an area enclosing for protection said cranks 6, said tie rod 7 and an extension operative spring 7*s* positioned between the shutter frame assembly 8 and the be rod 7 such as to wide open said shutter vanes 5 and 5*c* upon fan operation. This occurs regardless if said vanes are mounted vertically or horizontally.

On the opposite side of said shutter assembly 4, said housing enclosure 2 comprises a second opening 3" of a substantially round shape including a safety guard 9 or screen provided for protecting people outside the building and for preventing anyone from reaching the rotating parts of the fan.

A noticeable advantage of said slanted housing is that it allows a full protection from the elements of the electric motor 10 and the mechanical and electrical components of said axial fan.

Further advantage is that the dust will not collect within the propeller fan housing and even if there is some dust accumulation on the bottom part of the fan housing, said dust can easily be washed away. Moreover, the airflow is more efficient because the vanes are mounted at the fan intake where the air velocity is relatively lower and the airflow is more laminar in respect to vanes mounted at the fan outlet where the air velocity is higher and the airflow is turbulent.

In the fan of this invention, the air sucked by the propeller is directed from the square intake opening of said fan housing enclosure to the Venturi and propeller with a minimum of restrictions and turbulence. The applicant provides an inlet bell mouth, a shutter assembly with few large blades, for smoothly guiding the dusty laden air from the inlet bell mouth toward said Venturi with reduced turbulence. On the contrary, the prior art shutters have too many blades. Fewer blades positively closed result in a substantially airtight shutter.

The shutter vanes are designed with overlaps for perfect closing, the mating surfaces of said overlaps. When the fan is not operating the operative compression spring 25 of said axial sliding reciprocating actuator urges together the mating surfaces of adjacent vanes therefore firmly closing the vanes to prevent convection heat losses across said shutter assembly 4.

When the fan is off, all the vanes 5 and 5*c* are in a closed position with their faces parallel to the inlet face 3 of the fan housing 2. When the fan is operating, said vanes 5 and 5*c* rotate to an angle such that said faces substantially align with the airflow.

Referring to FIG. 1A, the improved shutter assembly 4 and its square frame 8 are symmetrical built in rapport to the axis X, Y. Thus they are suitable to be mounted on the intake square opening of said fan housing enclosure 2 with shutter vanes 5 and 5*c* working horizontally or vertically. The user of the present invention can rotate said shutter assembly by 90 degrees and mount the self-opening shutter assembly 4 with their vanes in either way, such as horizontally as prior art fans, or vertically.

In the high efficiency fan of the present invention, dust particles present in the air will flow quickly from the bell mouth 8*i* of said square intake opening 3 across the compact slanted housing toward the outlet opening 3" without dust settling as the vanes are mounted vertically. Any dust present in the airflow eventually will settle on the bottom area of said slanted fan housing enclosure from where it can be easily washed out away from the building.

With this invention, any loss of air delivery caused by air pressure needed to hold the gravity shutters open is eliminated allowing the improved axial flow fan of the present invention to have maximum air flow which is never decreased by dust accumulation on shutters.

With reference to FIG. 2, the fan housing enclosure 2 comprises a drive motor 10 that is either electric or hydraulic, suitable for speed regulation, slidably mounted on a rigid base member 11, secured with bolts 11*b* to a streamlined central structural member 12 supporting the fan and comprising airfoil shaped wings 12*w* designed for guiding efficiently the air flow so that turbulence is minimized and more laminar flow is achieved. The central structural member 12 is mounted within the housing enclosure 2. It is axially spaced from said openings of said housing enclosure 2 and connects opposite sides of said fan housing 2 by means of a pair of L shaped streamlined brackets 13 which are bolted at each end to the top and bottom portion of said fan housing 2 respectively with bolts 13 *b*.

For large fans, it is preferable to brace said central structural member with horizontal arms equipped with airfoil wings.

The central structural member 12 is made of an aluminium tube and extends substantially perpendicular to a rotating shaft 14 which is supported by a pair of pillow blocks bearings 15 bolted with bolts 16 to said central structural member 12 and passing through an opening of it, substantially in the middle thereof, coaxially with the fan rotational axis.

This arrangement of said central structural member 12 and airfoil shaped wings 12*w* minimizes obstruction of airflow through the fan housing enclosure and minimizes turbulence in the airflow for maximum fan efficiency.

As can be clearly seen in FIGS. 2, 3A,3B, 4, 5, 6, a versatile centrifugal mechanism generally indicated 17 as a whole, is mounted onto one end of a fan drive shaft 14 adjacent to the central operative vane 5*c*.

The centrifugal shutter mechanism 17 is designed to close the shutter assembly 4 when the motor 10 is shut off, and allows the vanes 5 and 5*c* to open as soon as the fan starts to run and reaches its minimum operational speed which is of about 250 RPM.

The centrifugal shutter mechanism 17 proposed in the invention includes a hermetic housing 18 secured to one end of the rotating shaft 14 and is positioned adjacent to said central operative vane 5*c* of said shutter assembly 4. Said hermetic housing 18 comprises a pair of matching shells 19*a* and 19*b* made of molded plastic, bolted together with bolts 20 and 20*p*. Each shell has a pair of radially extending cavity, symmetrically spaced in respect to the fan axis of rotation and an axial extending cavity located coaxially to the fan rotational axis.

Figure 5:
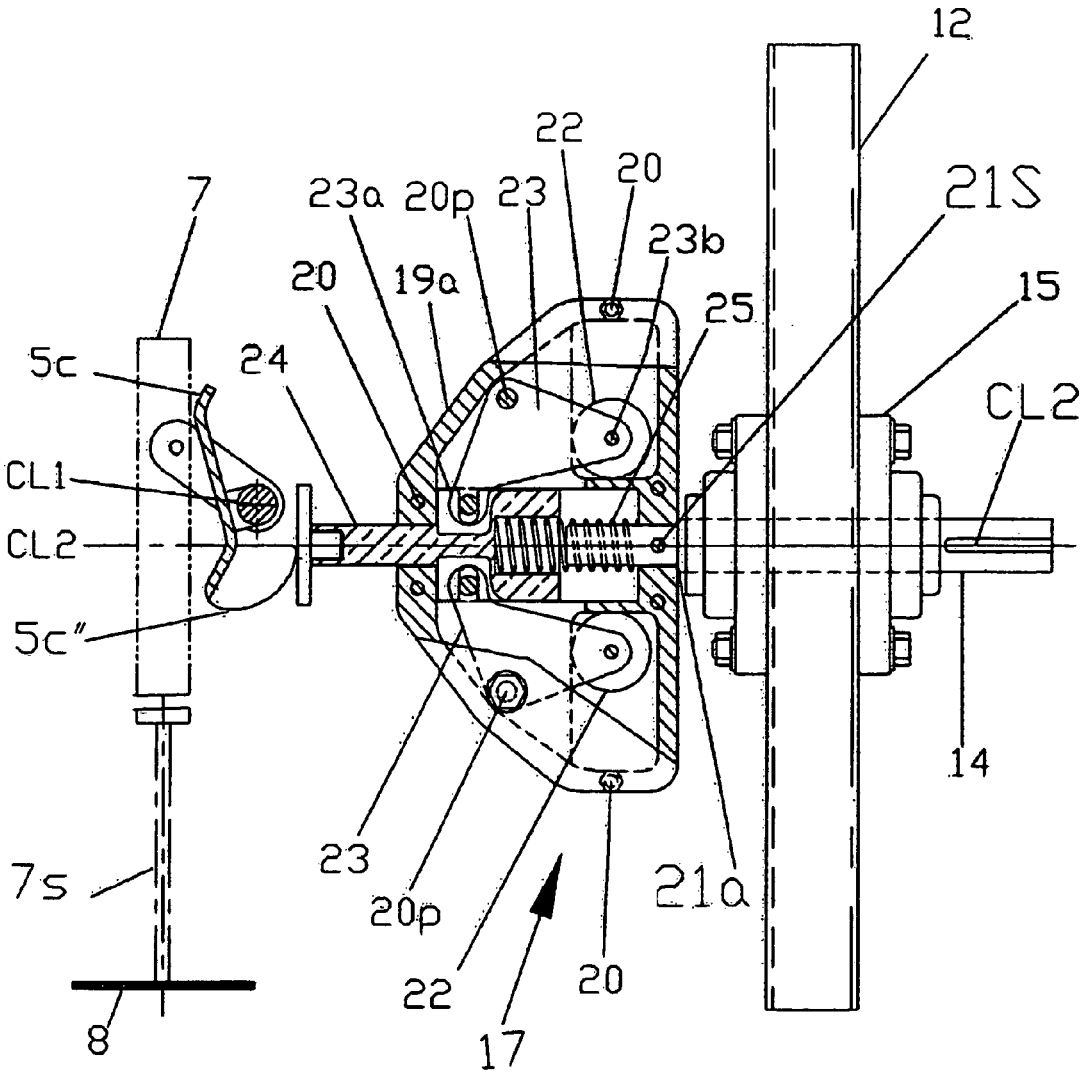
FIG. 5 is a side elevation view partially in section of the centrifugal shutter mechanism showing the central operative vane of the self-opening shutter with its cam dosed by the internal compression spring of the axial sliding reciprocating actuator.
Figure 6:
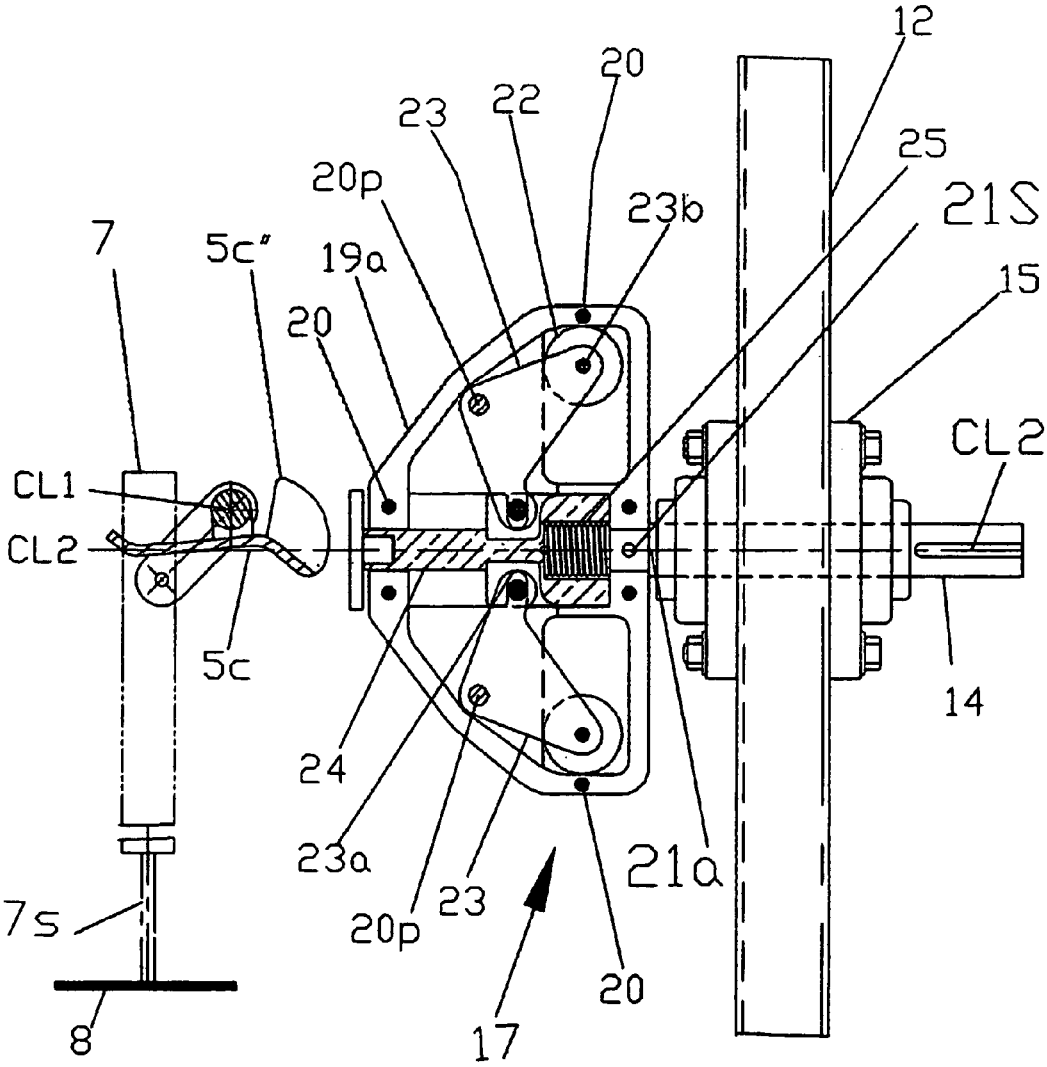
FIG. 6 is a side elevation view looking inside the centrifugal shutter mechanism with half of the hermetic housing removed for clarity, showing the central operative vane of the self opening shutter wide open by the shutter frame extension spring.

As shown in FIG. 5 and FIG. 6, said hermetic housing 8 comprises a first inlet opening 21*a* for securing it to the fan rotating shaft 14 as shown for a mechanism designed to move away from an element to be actuated.

Figure 4:
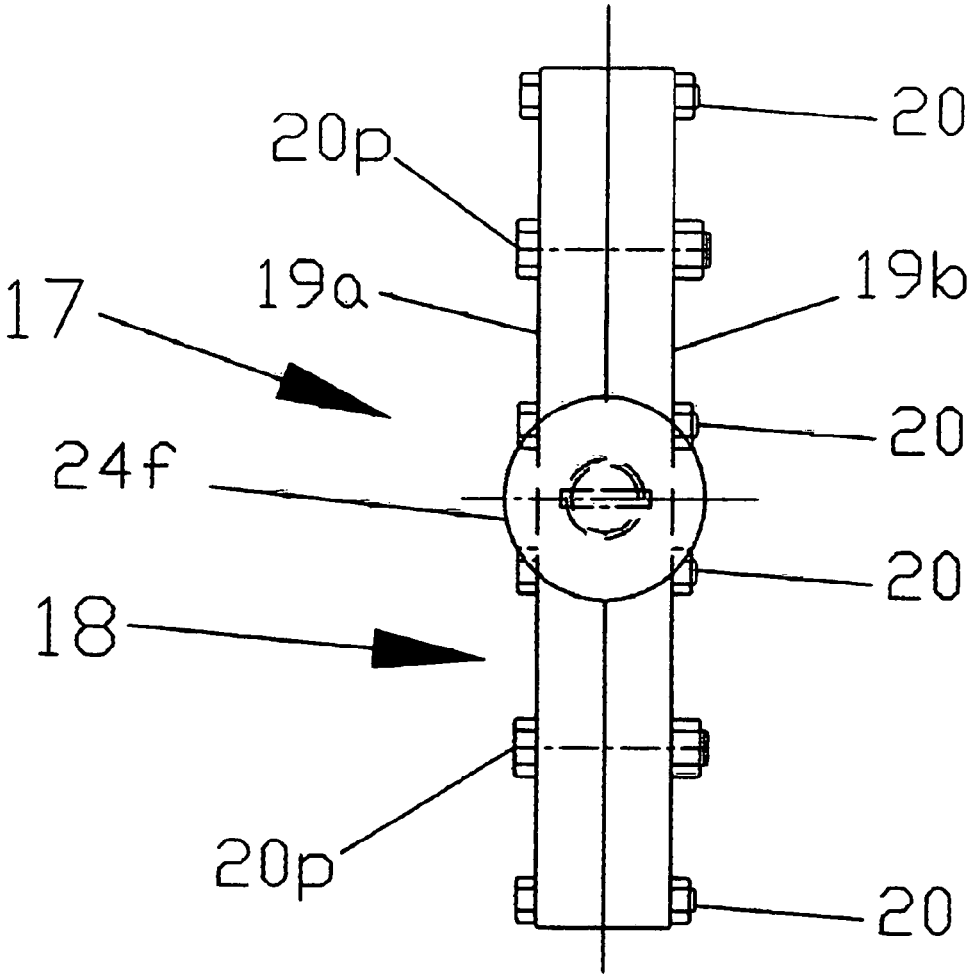
FIG. 4 is a front view of the centrifugal shutter mechanism.

Said hermetic housing 18 is secured to fan rotating shaft 14 with a spring pin 21S as shown in FIGS. 4, 5 and 6. The hermetic housing 18 has been designed such as to prevent dust accumulating in the components of the apparatus therefore significantly extending the maintenance period of the centrifugal shutter mechanism. It comprises a pair of radial steel masses 22 mounted within said radial cavities, symmetrically spaced in rapport to the fan rotational axis and bolted with bolts 23*b* to a pair of triangle shaped arms 23 which are pivotally mounted on pivots 20*p* which are secured to said hermetic housing 18. Each of said triangle shaped arm 23 is provided with an appendix 23*a* adapted for movably engaging an axial sliding reciprocating actuator 24 which is provided with a slotted opening extending across it for receiving said appendix 23*a* of each shaped triangular arm 23. Therefore, said masses 22 are able to swing equally in unison to simultaneously move the axial sliding actuator 24 toward the shutter central operative vane 5*c* or away from it.

The axial sliding reciprocating actuator 24 has a parallelepiped shape. It is made of plastic and is slidably mounted inside said central hollow cavity which is coaxial to the fan axis of rotation CL2 and comprises an internal compression spring 25 located within said axial sliding reciprocating actuator 24. Said compression spring 25 has one end biased to the inside front wall of the axial sliding reciprocating actuator 24 and the other end biased to the inside wall of said hermetic housing 18 as pictured in FIG. 5 and FIG. 6.

The axial sliding reciprocating actuator 24 further has a front end comprising a flange 24*f* adapted to frictionally engage a convex shaped cam 5*c*" positioned substantially in the middle of said central operative vane 5*c* such to rotate and close said central vane 5*c* when the motor 10 is shut off. Said central vane 5*c* has a longitudinal axis CL1 perpendicular to the fan axis of rotation CL2.

More specifically, in order to have a suitable mechanical vantage for easing the operation of the rotation of the central operative vane 5*c*, said axes CL1 and CL2 are adequately offset as shown in FIG. 2, 5 and FIG. 6.

Said axial sliding reciprocating actuator 24 can slide inward into said hermetic housing 18 for effect of the centrifugal force of said pair of radial masses 22 for permitting the opening of the vanes 5 and 5*c*. It can also slide outwardly of said hermetic housing 18 toward the central operative vane 5*c*, for effect of the pushing force of said internal compression spring 25 applying a force to said cam 5*c*" for positively closing the central operative vane 5*c* and the other vanes 5 to prevent air, rain or other matter passing through the shutter assembly 4 and further preventing vibrations and the rattling of said vanes when the fan is not in operation.

Figure 7:
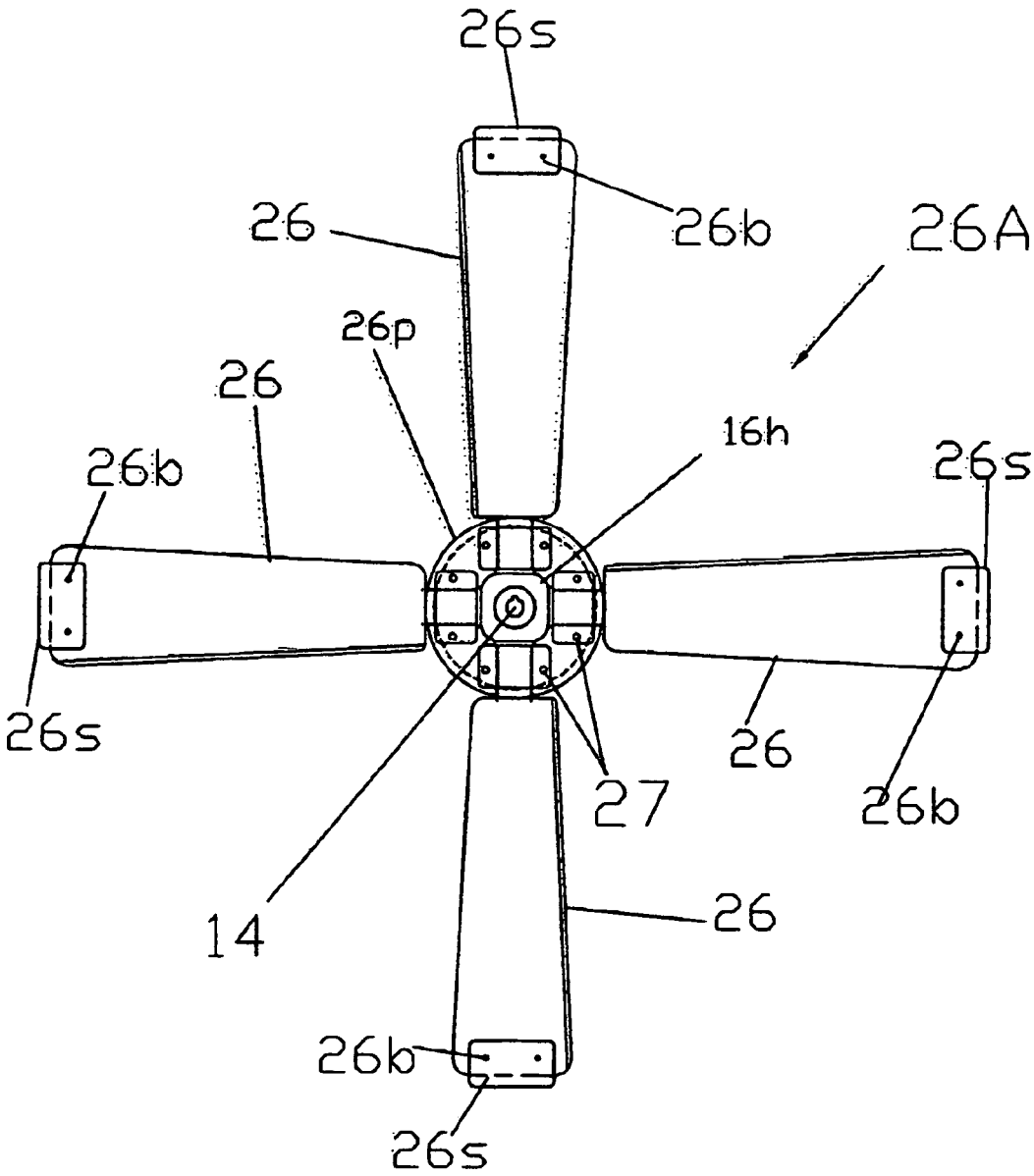
FIG. 7 is a front elevation of the propeller assembly showing four radially extending airfoil shaped blades pivotally secured into a pulley hub and showing the radially slidably shoes adapted for adjusting the clearance between the propeller blade tips and the Venturi.

The fan further comprises a propeller assembly 26A, including a propeller rotating around said axis CL2, best shown in FIG. 2 and FIG. 7, and comprising a hub 16*h* with a pulley 26*p* axially adjacent said hub 16*h* which is secured on one end of the rotating shaft 14. The propeller assembly 26A comprises a plurality of airfoil shaped blades 26 extending radially outwardly from said hub 16*h* toward a tip region. The fan blades are designed for delivering efficiently and quietly a high volume of air, each of said blades 26 is pivotally received into said hub 16*h* and secured to it with bolts 27. The tip region of said propeller blades 26 are substantially surrounded at a very close distance by the inner part of the said fan housing enclosure 2 which comprises a built in Venturi 28 designed for efficiently guiding the airflow toward the outlet of said axial fan. The fan pulley 26*p* is coupled to a motor pulley 29 with an endless belt 30.

In addition, the tip portion of each blade 26 comprises a radially slidably shoe 26*s* made of light rubber adapted for adjusting the clearance between the propeller blade tips and said Venturi 28. Said shoes 26*s* are secured to each blade tip with a pair of bolts 26*b* and the shoes are made of soft rubber.

The Applicant believes that, if in some situation said radial sliding adjustable shoes 26*s* come in contact with the Venturi 28, the light rubber will wear out without noise and will virtually seal off the gap between said Venturi 28 and the propeller blade tips.

A small, uniform clearance is preferred to reduce blade tip vortex formation thus reducing noise and preventing air from flowing back around the propeller blades tips for increased performance of the fan with less noise.

The fan of this invention practically does not need the cumbersome and expensive cones of prior art fans. As a result, the fan of the present invention is more compact and less expensive to build and to operate.

The amount of clearance between Venturi and propeller blade tips becomes more critical With increasing static pressure. At zero static pressure, the effect of the tip blade clearance is minimal but the losses of fan performance increase quickly with increasing static pressure. The fan of the present invention is suitable to work at relatively higher pressure in relation to prior art axial fans.

The functioning of the centrifugal mechanism 17 may readily be understood by reference to FIGS. 2, 3A, 3B, 4, 5 and 6. When the motor 10 starts to rotate, its rotation is transmitted from the motor pulley 29 to fan pulley 26*p* and rotating shaft 14. Thus, as the fan speed increases and reaches the minimum designed speed of operation of about 250 RPM, said centrifugal masses 22 start to move radially by centrifugal effect. This causes the arms 23 to rotate around the pivots 20*p* pushing in the meantime the axial sliding actuator 24 inward said hermetic housing 18 against the urge of said compression spring 25. Therefore, the axial sliding reciprocating actuator 24 moves axially away from the cam 5*c*" of said central operative vane 5*c* enabling the shutter vanes 5 and 5*c* to open for effect of the air drawn by the propeller blades 26 into the fan housing enclosure 2 and wide open for effect of the additional thrust of the extension operative spring 7*s*. Said spring 7*s* applies a force to the tie rod 7 and a torque to the shutter vanes 5 and 5*c* urging them to rotate in open position, substantially aligned to the airflow.

As it can be clearly seen, FIG. 6 shows in detail the centrifugal shutter mechanism in its open operative position showing a substantial gap between the front operative end 24*f* of said axial sliding reciprocation actuator 24 and said cam 5*c*".

When the fan is operating, said shutter assembly 4 is kept positively opened by the thrust of said extension operative spring 7*s*. Therefore, when said vanes are in their open position, there is no tendency of them to close and there is no air pressure required to keep them wide open. Therefore, the traditional vibrations, wear and undesirable noises through said shutter assembly 4 are eliminated regardless of whether said vanes are mounted horizontally or vertically across the square intake opening 3 of said fan housing enclosure 2.

When the electric or hydraulic motor 10 is shut off, the propeller speed decreases progressively so that the centrifugal forces of said centrifugal masses 22 decrease. Consequently, said compression spring 25 pushes the axial-sliding actuator 24 forwardly in direction and against the cam 5*c*". In the first moment, said axial sliding actuator operative front-end 24*f* closes said existing gap then enters into contact with said convex shaped cam 5*c*" causing its rotation around its longitudinal axis CL1 and simultaneously urging said tie rod 7 to rotate the other vanes 5 in their closed position whereby, the shutters 5 and 5*c* are positively closed.

Large fans operate at low speed and have very heavy vanes. Therefore, for said application it may be desirable to use the centrifugal shutter mechanism such as to rotatably connect the central vane of said shutter assembly and push it with the axially sliding actuator using the significant radial forces of the centrifugal masses to open the heavy vanes.

The centrifugal device of the present invention is simple, cost effective and allows a gradual and quiet automatic opening and closing of said vertical or horizontal mounted vanes.

Another major advantage of the present invention is that the improved fan housing can be made of plastic with the roto-mold technology. Moreover, it is designed to nest which means that said housings can be stacked next to each other and many units can be shipped or stored for significantly reducing shipping cost and space.

In the drawings and specifications, there has been set forth some preferred embodiments of the invention. Although specific terms are employed, they are used in a generic and descriptive sense only and not for purpose of limitation. Thus, many modifications are possible, some of which have already been mentioned, while other variations can be made thereto It will thus be seen that the object set forth above and those made apparent from the foregoing description are fully effectively attained.

In today's energy conscious world, it has become desirable to increase the efficiency of the air moving devices as much as possible. One way to accomplish this is to provide a high quality fan with the unique features of the fan of the present invention.

The invention claimed is:

1. An improved axial fan for exhausting humid, corrosive and dusty air, the improvements comprising:

a) a housing enclosure having an inner cavity defining an air flow passageway having large radii corners and having a first opening of square section with a shutter assembly comprising a frame on which are pivotally mounted a plurality of vanes including a central vane, for closing or opening said first opening, each of said vanes being pivotally interconnected, with crank rods and at least one tie rod, said frame further comprising an operative extension spring with one end connected to said frame and the other end connected to said tie rod for urging, upon fan operation, the shutter vanes toward a full wide open position, b) an axially spaced second opening of round section including a safety guard, c) a streamlined central structural member, axially spaced between said openings, connecting two opposite sides of said housing enclosure and comprising a pair of airfoil wings for guiding efficiently the air flow, d) a drive motor that is either electric or hydraulic mounted on a rigid base secured to said central structural member, e) a propeller-pulley assembly secured at one end of a rotating shaft fitted into a pair of pillow block bearings bolted to said central structural member for rotatably holding said propeller-pulley assembly comprising a plurality of airfoil blades extending radially outwardly from said propeller-pulley assembly and rotating with said propeller-pulley assembly, said propeller pulley assembly being located opposite to said shutter assembly, f) a venturi built with said fan housing enclosure, substantially entirely surrounding at close distance the blade tips of the propeller, g) a centrifugal shutter mechanism, connected at one end of said rotating shaft of said fan, for moving the shutter from a closed position, when the fan is disabled, to a normally open position when the fan is enabled, and comprising a hermetic housing assembly, said housing being made up of a pair of matching molded shells comprising a pair of oppositely radially extending cavities, each cavity including a pair of movable masses equally spaced apart relative to the fan rotational axis and operatively connected to an axially sliding reciprocating actuator via a pair of arms pivotally attached to said hermetic housing, said arms being operatively connected at corresponding ends respectively to the axially sliding actuator located into an axially extending cavity of said hermetic housing coaxially to said fan axis of rotation and positioned adjacent to said central vane of said shutter assembly, said axial sliding actuator further comprising an internal operative spring and an operative end located in proximity to the shutter central vane, said actuator being movable between an outward position frictionally engaging a convex shaped cam secured to said central vane of said shutter to rotate and shut said shutter central vane and the other vanes by the biasing force of said internal spring and an inward position away from said central vane of said shutter for causing the opening of said shutter in response to the rotation of said propeller, said opening and closing controlled by the minimum speed of operation of the fan.

2. The fan as claimed in claim 1, wherein said plurality of radial airfoil blades comprise radially extending adjustable flexible means mounted at the tips of each blade for adjusting the tip blade clearance with said venturi of said fan housing, said improved housing including a rigid roll-formed ring located adjacent to said blade tips.

3. The fan as claimed in claim 2, wherein said adjustable flexible means are made of soft rubber adapted to minimize the clearance between the venturi and blade tips for preventing air from flowing back around the blade tips for increased performance of said fan, enabling said fan to work efficiently at higher static pressure with reduced air vortices, vibrations and noise.

4. The fan as claimed in claim 1, wherein said square frame of said shutter assembly includes longitudinally extending cavities and comprises plastic rods on which are pivotally received said vanes of said shutter, said frame assembly being adapted to be mounted selectively either horizontally or vertically across said inlet opening of said fan housing.

5. The fan as claimed in claim 1, each of said arms being movably connected at corresponding ends with said axial sliding actuator for transferring radial movements of said centrifugal masses, upon fan rotation, to axial movements of said axial actuator, so that said centrifugal masses and said arms will swing in unison during any axial stroke of the axially sliding actuator.

* * * * *